US006932648B1

(12) United States Patent
Chiu et al.

(10) Patent No.: US 6,932,648 B1
(45) Date of Patent: Aug. 23, 2005

(54) FLEXIBLE PRINTED CIRCUIT CONNECTOR CAPABLE OF PREVENTING ELECTROMAGNETIC INTERFERENCE

(75) Inventors: Hsien-Yu Chiu, Taoyuan (TW); Hsine-Kuang Shih, Taoyuan (TW)

(73) Assignee: P-Two Industries Inc., Taoyuan (TW)

( * ) Notice: Subject to any disclaimer, the term of this patent is extended or adjusted under 35 U.S.C. 154(b) by 0 days.

(21) Appl. No.: 10/902,941

(22) Filed: Aug. 2, 2004

(51) Int. Cl.[7] ..... H01R 13/648
(52) U.S. Cl. ..... 439/607; 439/492; 439/497
(58) Field of Search ..... 439/607, 492, 439/495, 496, 497

(56) References Cited

U.S. PATENT DOCUMENTS 6,165,008 A * 12/2000 Wu et al. ..... 439/492
6,273,753 B1 * 8/2001 Ko ..... 439/579
6,319,060 B1 * 11/2001 Wu ..... 439/607
6,659,791 B1 * 12/2003 Ko et al. ..... 439/353
6,705,893 B1 * 3/2004 Ko ..... 439/607
6,811,439 B1 * 11/2004 Shin-Ting ..... 439/607

* cited by examiner

*Primary Examiner*—Tho D. Ta
(74) *Attorney, Agent, or Firm*—Bacon & Thomas

(57) ABSTRACT

This invention discloses an electromagnetic interference (EMI) resisting flexible printed circuit (FPC) connector having an EMI shielding metal housing for suppressing and eliminating external noises or electromagnetic waves, which can prevent damage, deformation and distortion to the signal transmission, and also can enhance the stability of system operations. Further, another type of EMI resisting FPC connector has a grounding metal panel disposed on a guide board of a movable lid of the FPC connector, in addition to having the EMI shielding metal housing, and such grounding metal panel is electrically connected with the metal housing of the FPC connector when the connector is in use, so that any noise or electromagnetic wave produced by the FPC will be directed and dispersed to the ground through the metal housing of the FPC connector, and thus fully complying with the standard of EMI control of the electronic product and also enhancing the electromagnetic compatibility (EMC) among electronic products.

20 Claims, 4 Drawing Sheets

FLEXIBLE PRINTED CIRCUIT CONNECTOR CAPABLE OF PREVENTING ELECTROMAGNETIC INTERFERENCE

BACKGROUND OF THE PRESENT INVENTION

1. Field of the Present Invention

The present invention relates to a flexible printed circuit (FPC) connector, more particularly to a flexible printed circuit connector capable of preventing electromagnetic interference (EMI).

2. Description of Prior Act

Since the operating frequency of present electronic products is increasing constantly, therefore more and more electromagnetic radiation is produced by the electric power when operating the electronic product. As a result, electronic products often work improperly or unstably under the condition of electromagnetic interference (EMI).

Therefore, the electromagnetic interference due to the leakage of electromagnetic waves produced by the electronic products has become an environmental pollution issue to this new century, and countries of the word started establishing strict standard for controlling electromagnetic interference to solve the serious problem created by electromagnetic interference. More particularly, the electromagnetic compatibility (EMC) among electronic products tends to have stricter requirements and deserves more attention.

However, the most direct way to prevent electromagnetic interference is to use a metal housing having the electromagnetic interference shielding effect. Besides completely isolating the circuit devices of the electronic product from the outside, the EMI shielding also grounds the metal housing to direct and disperse the electromagnetic waves to the ground to preclude EMI from electronic products and maintain the stability of their applications.

Almost all of the present connector products, more particularly the flexible printed circuit (FPC) connectors, do not come with a metal housing having the EMI shielding effect. Therefore, the present connectors still lack of the capability of resisting external noises and eliminating EMI.

Therefore, data transmissions are usually interfered by external noises or electromagnetic waves, and thus it will cause damage, deformation or distortion to signal transmission and further affect the stability of system operations.

Referring to FIG. 1, the structure of a prior flexible printed circuit connector 10 comprises a long insulating body (also known as insulator base) 11, a movable lid 12 and a plurality of terminal pins 13. These components are disposed on a printed circuit board 90 to be used by a flexible printed circuit (FPC) 95 and electrically connected.

However, such prior flexible printed circuit (FPC) connector 10 does not come with an EMI resisting housing, therefore it will be interfered by external noises and electromagnetic waves and thus affecting the stability for a normal operation.

SUMMARY OF THE PRESENT INVENTION

It is therefore a primary objective of the present invention to provide an EMI resisting FPC connector, since the EMI resisting FPC connector has an EMI shielding metal housing, therefore such connector shall prevent damage, deformation and distortion of the signal transmission and enhance the stability of system operations.

The secondary objective of the present invention is to provide an EMI resisting FPC connector, particularly the one having a metal housing. Wherein the metal housing comprises an upper metal panel and a lower metal panel being coupled with each other, and two split bending boards are embedded into both sides of the body of the lower metal to define two split bending boards, and one of the bending boards is drawn back and curved into an inverted "L" shape, and the other is opened and curved into a "L" shape.

Therefore, the two drawn-back bending boards on both sides of the body of the lower metal panel define a space having a function similar to a drawer for accommodating and fixing the insulating body of the FPC connector and also defining the panel of the lower metal panel as the bottom of the insulating body. In the meantime, the panel of the upper metal panel covers and shelters the panel of the insulating body. The upper metal panel and the lower metal panel constitute the metal housing of the FPC connector for directing and dispersing electromagnetic waves to the ground, and thus having the EMI resisting function.

Further, since the two opened bending plates disposed between both sides of the insulating body and both sides of the panel of the lower metal panel keep a distance apart, therefore a guide track space for accommodating the left and right wings of the movable lid of the FPC connector is defined. The guide track space together with the left and right wings of the movable lid constitute a sliding mechanism, such that the movable lid corresponding to the insulating body of the FPC connector can be pulled out or pushed in, and thus constituting an EMI resisting FPC connector.

Another objective of the present invention is to provide an EMI resisting FPC connector, wherein the guide board of the movable lid of the FPC connector comes with a grounding metal panel. When the movable lid of the FPC connector is pushed into the insulating body at a fixed position against the insulating body, the grounding metal of the movable lid is electrically in contact with a contact member disposed on the panel of the lower metal panel; if the FPC connector is transmitting data, the noise or electromagnetic wave produced by the FPC will be directed and dispersed to the ground to meet the EMI control standard of the electronic product and improve the EMC among electronic products.

Another objective of the present invention is to provide an EMI resisting FPC connector, wherein a separation-resisting lid is protruded individually from both sides of the panel of the upper metal panel. The separation-resisting lid and the lower metal panel are assembly to form the metal housing of the FPC connector for preventing the movable lid of the FPC connector and the insulating body from being detached from each other.

BRIEF DESCRIPTION OF THE DRAWING FIGURES

Figure 4:
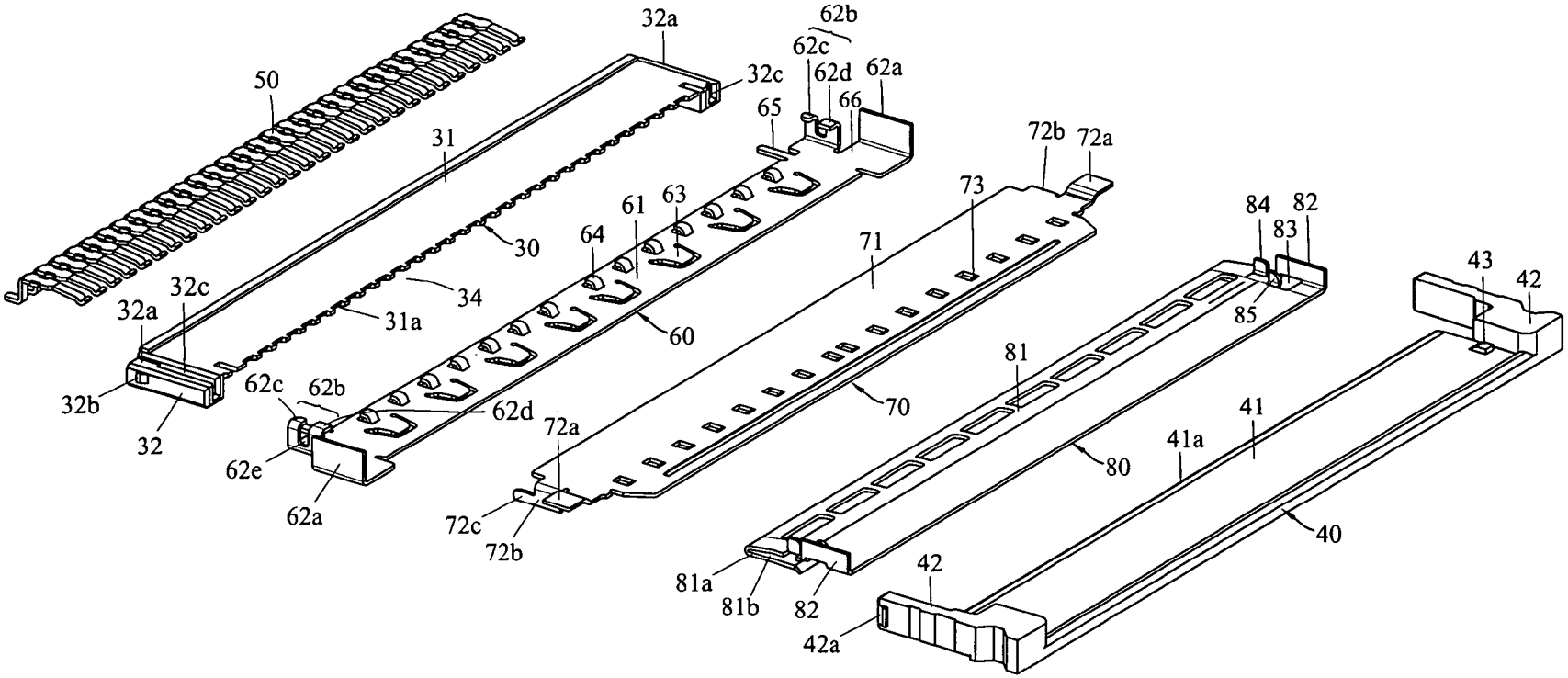
FIG. 4 is an exploded view of the FPC connector 20 of the present invention.
Figure 5:
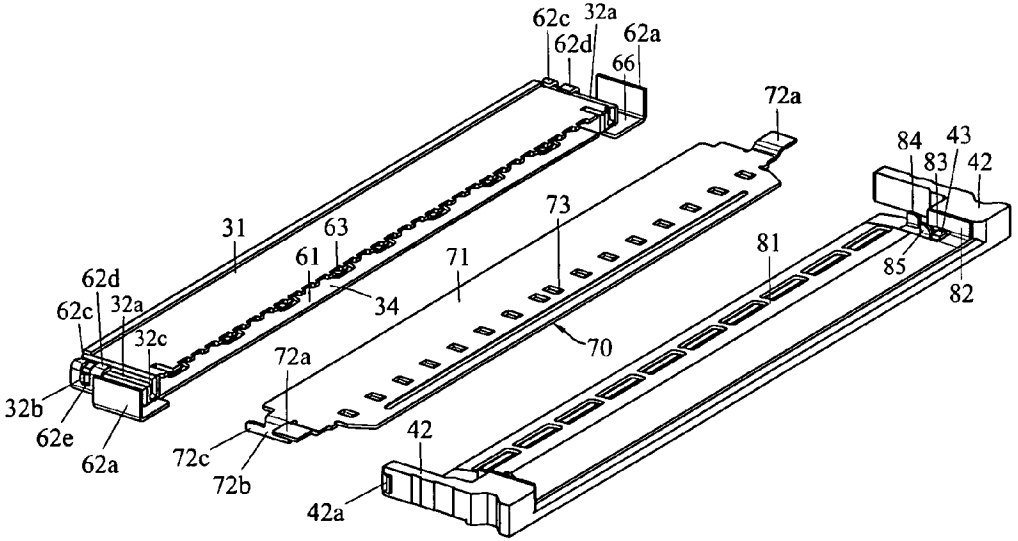

FIG. 5 is an illustrative view of the insulating body 30 and the lower metal panel 60 being integrated to define a metal housing for the bottom of the insulating body 30 as depicted in FIG. 4 and the grounding metal panel 80 being embedded into the guide board 41 of the movable lid 40 as depicted in FIG. 4 according to the present invention.

Figure 6:
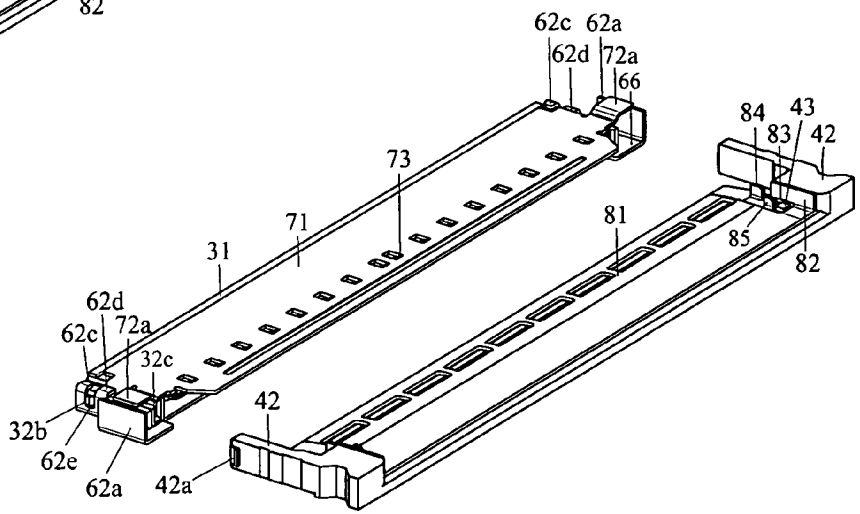

FIG. 6 is an illustrative view of the insulating body 30 and the upper metal panel 70 being integrated to define a metal housing for the top of the insulating body 30 as depicted in FIG. 5 and the FPC connector 20 using the lower metal panel 60 and the upper metal panel 70 to constitute the metal housing for the FPC connector 20 according to the present invention.

Figure 7:
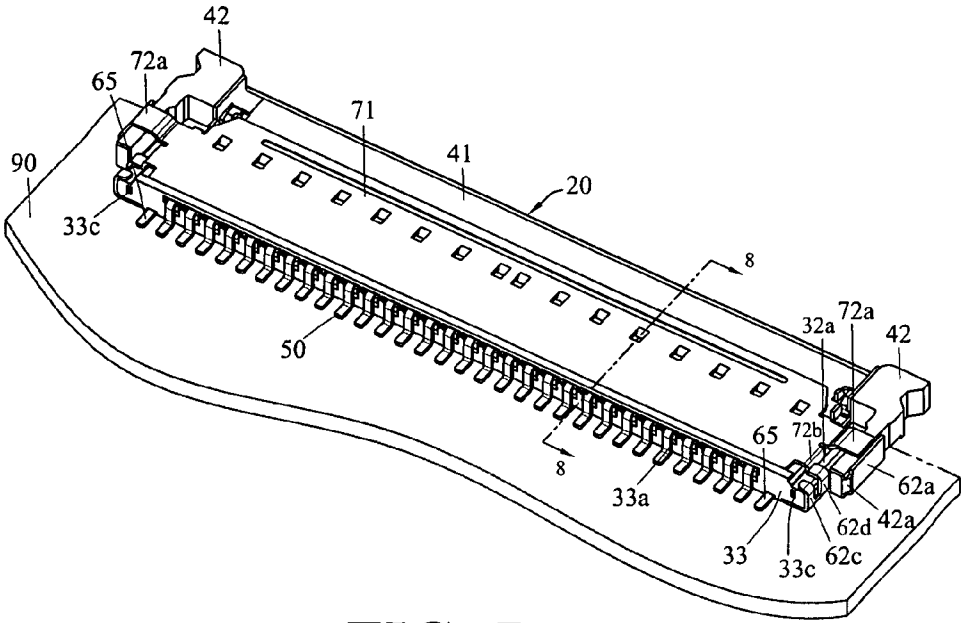

FIG. 7 is an illustrative view of the FPC connector 20 being built on the printed circuit board 90 and using the grounding pin 65 of the lower metal panel 60 of the FPC connector 20 to constitute a grounding status according to the present invention.

Figure 8:
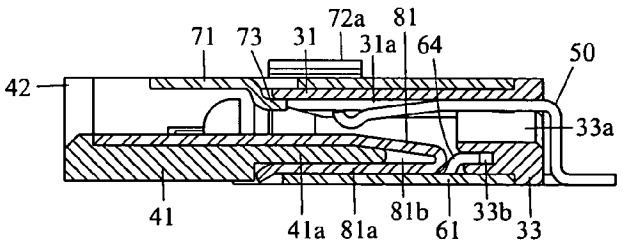

FIG. 8 is an enlarged cross-sectional view of the Section 8—8 of the FPC connector 20 as depicted in FIG. 7.

DETAILED DESCRITION OF THE PREFERRED EMBODIMENTS

Referring to FIGS. 2 to 8, a flexible printed circuit (FPC) connector 20 of this present invention comprises an insulating body 30, a movable lid 40, a plurality of terminal pins 50, a lower metal panel 60, an upper metal panel 70 and a grounding metal panel 80.

Particularly, the lower metal panel 60 and the upper metal panel 70 are used to cover and shelters the top, the bottom and both sides of the insulating body 30, and the grounding metal panel 80 is used to cover and shelter a guide board 41 of a movable lid 40, so that the FPC connector 20 has a metal housing with an EMI resisting effect and the FPC connector 20 has an EMI resisting function.

Figure 1:
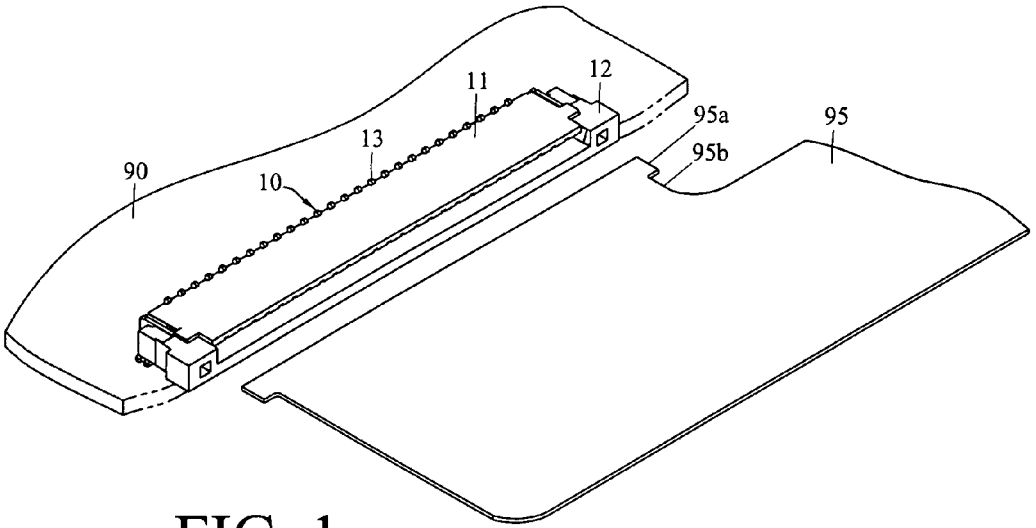
FIG. 1 (prior art)
FIG. 1 is an illustrative view of a prior art FPC connector 10.

Moreover, the FPC connector 20 of this present invention as shown in FIGS. 7 and 8 is built on a printed circuit board 90 to be used by and electrically connected to a flexible printed circuit (FPC) 95 as shown in FIG. 1. When the FPC connector 20 of this present invention is used to transmit data, if the FPC 95 will produce noises or electromagnetic radiation, then a panel 81 of the grounding metal panel 80 and a panel 61 of the lower metal panel 60 are electrically in contact to direct and disperse the noise or magnetic wave produced by the FPC 95 to the ground.

Therefore, the FPC connector 20 of this present invention shall meet the standard of the EMI control of electronic products and enhance the electromagnetic compatibility (EMC) among electronic products.

Further, the FPC connector 20 of this present invention may also omit the component of a grounding metal panel 80, and comprises an insulating body 30, a movable lid 40, a plurality of terminal pins 50, a lower metal panel 60 and an upper metal panel 70 to constitute another preferred embodiment of the present invention. The FPC connector 20 of this mode still has a metal housing with the electromagnetic shielding effect and an EMI resisting function.

As shown in FIGS. 4, 7 and 8, the insulating body 30 of this present invention is a panel 31 having a long board surface, and such panel 31 comes with an appropriate thickness and constitutes a sidewall 32 on both sides and a back wall 33. In the meantime, a plurality of parallel channels 31*a* is formed at the bottom of the panel 31 of the insulating body 30, so that the internal structure of the insulating body 30 forms an opened pocket shape and has a hollow embedding groove 34 at its bottom, and each pin at the front section of said plurality of terminal pins 50 shall be embedded into the corresponding channels 31*a*.

Part of the thickness of each sidewall 32 of the insulating body 30 is slashed to form a guide track structure, and each sidewall 32 forms an embedding section 32*a* of the guide track structure for being used together with a lower metal panel 60 in the future. If the lower metal panel 60 and the insulating body 30 are integrated as a whole, the panel 61 of the lower metal panel 60 seals the hollow area of the embedding groove 34 of the insulating body 3, and thus constituting the bottom of the embedding groove 34 of the insulating body 30. With the foregoing structure, the bottom of the insulating body 30 has a metal housing.

As shown in FIGS. 4, 5 and 7, a channel 32*c* is disposed on the embedding section 32*a* of the sidewalls 32 on both sides of the insulating body 30, and these two channels 32*c* are disposed on and interconnected with an embedding hole 33*c* disposed on both sides of the back wall 33 of the insulating body 30. Therefore the channels 32 and the embedding holes 33*c* disposed on both sides of the insulating body 30 shall be used together with the upper metal panel 70.

As shown in FIGS. 5 and 6, if the upper metal panel 70 and the insulating body 30 are integrated as a whole, the bending section 72*b* disposed on both sides of the panel of the upper metal panel 70 is embedded inside the channel 32*c* on both sides of the insulating body 30, and thus defining an insert pin 72*c* disposed at the front of the bending section 72*b* on both sides of the upper metal panel 70 is inserted into the embedding hole 33*c* on both sides of the back wall 33 of the insulating body 30. With such embedding structure, the upper metal panel 70 is fixed on the insulating body 30 and the panel 71 of the upper metal panel 70 covers and shelters the panel 31 of the insulating body 30, and thus constituting the metal housing on the insulating body 30.

As shown in FIGS. 7 and 8, on the back wall 33 of the insulating body 30 comprises a plurality of openings 33*a* being correspondingly interconnected with the corresponding channel 31*a* inside the embedding groove 34 of the insulating body 30; a plurality of terminal pins 50 with its pins at the front section embedded into each corresponding channel 31*a* through the opening 33*a* of the back wall 33 of the insulating body 30, such that the pins at the rear section of the plurality terminal pins 50 are exposed to the outside.

Therefore, once the FPC 95 is inserted into the embedding groove 34 of the insulating body 30, the FPC 95 will be electrically connected with the pins at the front section of the terminal pins 50.

Further, to strengthen the assembling structure between the insulating body 30 and the lower metal panel 60, the present invention provides another embodiment for the structure of the insulating body 30. As shown in FIGS. 4 and 5, a latch member 32*b* is protruded from the lateral side of the sidewalls 32 on both sides of the insulating body 30 as to achieve the effect of strengthening the lower metal panel 60, when the lower metal panel 60 and the insulating body 30 are integrated as a whole.

Alternatively, as shown in FIGS. 7 and 8, a channel structure 33*b* is built on the front side of the back wall 33 of the insulating body 30 as to achieve the same effect of strengthening the lower metal panel 60, when the lower metal panel 60 and the insulating body 30 are integrated as a whole.

To provide further another embodiment for the structure of the insulating body 30, in addition to building a latch member 32*b* on the lateral side of the sidewalls 32 on both sides of the insulating body 30, the insulating body 30 may simultaneously build a channel structure 33*b* on the wall before the back wall 33.

As shown in FIG. 4, the lower metal panel 60 of this present invention has a long panel 61, and two split bending boards individually disposed on both sides of the panel 61; wherein one of the bending boards is drawn backward to form an inverted L-shaped internal bending board 62*b* and the other bending board has an opened shape to form an L-shaped external bending board 62*a*. With such structure, the two corresponding internal bending boards 62*b* disposed on both sides of the lower metal panel 60 shall form a space with a function similar to a drawer for accommodating and fixing the insulating body 30.

Therefore, when the lower metal panel 60 and the insulating body 30 are integrated as a whole as shown in FIG. 5, the two corresponding internal bending boards 62*b* of the lower metal panel 60 are embedded and engaged precisely with the embedding section 32*a* being disposed on both sides of the insulating body 30 and having a guide track function and thus limiting and fixing the insulating body 30 and integrating with the lower metal panel 60 as a whole.

In view of the above, the panel 61 of the lower metal panel 60 is defined as the bottom of the embedding groove 34 of the insulating body 30, after the lower metal panel 60 and the insulating body 30 are integrated as a whole, and thus providing a metal housing for the bottom of the insulating body 30.

Figure 2:
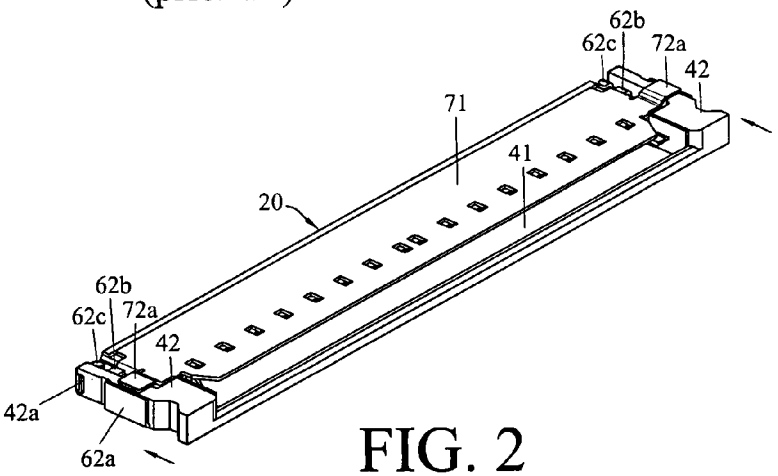
FIG. 2 is a perspective view of the FPC connector 20 being covered by the movable lid 40 according to the present invention.
Figure 3:
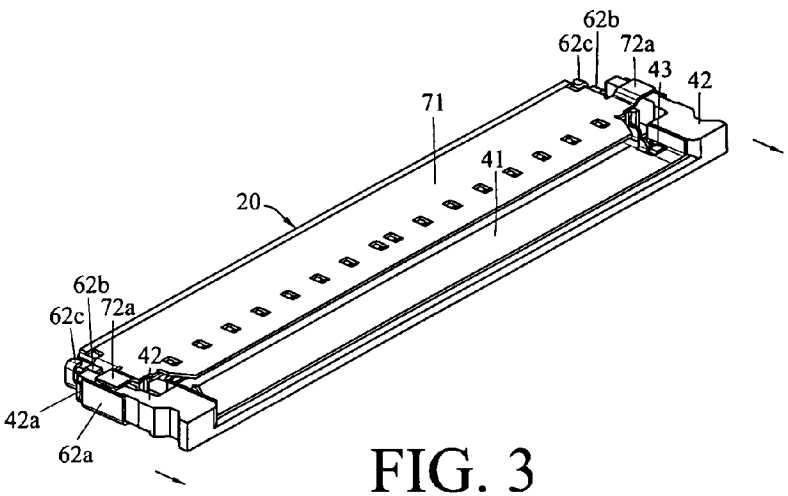
FIG. 3 is a perspective view of the FPC connector 20 with its movable lid 40 being pulled out according to the present invention.

In the meantime, the sidewalls 32 on both sides of the insulating body 30 keep a predetermined distance from the external bending boards 62*a* on both sides of the panel 61 of the lower metal panel 60 as shown in FIG. 5 to define a sliding space 66 in the shape of a sliding groove as shown in FIGS. 2, 3 and 7. In addition to accommodating the wings 42 on both sides of the movable lid 40 of the FPC connector 20, the external bending boards 62*a* of the lower metal panel 60, the side wall 32 of the insulating body 30 and the wing 42 of the movable lid 40 mutually define a sliding mechanism by such assembling structure, so that the movable lid 4 corresponding to the insulting body 30 of the FPC connector 2 shall be pulled out or pushed in.

To strengthen the assembling structure between the insulating body 30 and the lower metal panel 60, the present invention also provides another embodiment for the structure of the lower metal panel 60 to go with the structure of the insulating body 30. As shown in FIGS. 4 and 5, a tenon groove 62*e* is disposed on a vertical surface of the internal bending board 62*b* of the lower metal panel 60, so that the latch member 32*b* of the insulating body 30 is latched into the tenon groove 62*e* of the lower metal panel 60 to achieve the effective of securing the assembling structure between the insulating body 30 and the lower metal panel 60.

Alternatively, as shown in FIGS. 4, 7 and 8, an insert pin 64 is protruded from the panel 61 of the lower metal panel 60. The insert pin 64 of the lower metal panel 60 is embedded into a channel structure 33*b* of the insulating body 30 when the lower metal panel 60 and the insulating body 30 are integrated as a whole. By embedding the insert pin 64 of the lower metal panel 6 into the channel structure 33*b* of the insulating body 30, the present invention achieves the effect of strengthening the assembling structure between the insulating body 30 and the lower metal panel 60.

Further, a pair of grounding pins 65 is outwardly protruded from the panel 61 of the lower metal panel 6 as shown in FIG. 7. If the FPC connector 20 of the present invention is built on the printed circuit board 90, the pair of grounding pins 65 of the lower metal panel 60 and the printed circuit board 90 constitutes a grounding status, so that the whole metal housing of the FPC connector 20 is grounded.

In the meantime, a contact member 63 is protruded from the surface of the panel 61 of the lower metal panel 60 and has a slight resilience as shown in FIGS. 7 and 8. If the movable lid 40 is pushed into the embedding groove 34 of the insulating body 30, then a contact panel 81*a* of a grounding metal panel 80 on the guide board 41 of the movable lid 40 will be electrically connected with a contact member 63 of the lower metal panel 60. The grounding status defined by grounding the pair of grounding pins 65 of the lower metal panel 60 constitute a grounding status for the FPC connector 20.

Referring to FIGS. 4 and 5, to facilitate embedding and engaging the two corresponding internal bending boards 62*b* of the lower metal panel 60 onto the embedding section 32*a* of the insulating body 30 when the lower metal panel 60 and the insulating body are assembled, the internal bending board 62*b* of the lower metal panel 60 comes with a first bending board 62*c* and a second bending board 62*d* by means of building the latch groove 62*e* to facilitate embedding the insulating body 30. The second bending board 62*d* is longer then the bending section as shown in FIGS. 5 and 7. If another upper metal panel 70 is assembled to the insulating body 30 thereafter, the bent section of the second bending board 62*d* of the lower metal panel 60 will be in contact with the upper metal panel 70, such that the whole metal housing of the FPC connector 20 is grounded.

As shown in FIGS. 4 to 7 the upper metal panel 70 of this present invention has a long panel 71, a bending section 72*b* individually bent downward and disposed on both sides of the panel 71 of the upper metal panel 70, and an insert pin 72*c* protruded from the front end of each bending section 72*b*.

By embedding the bending section 72*b* of the upper metal panel 70 into the channel 32*c* of the embedding section 32*a* on both sides of the insulating body 32 and inserting the insert pin 72*c* of the bending section 72*b* of the upper metal panel 70 into the embedding hole 33*c* of the back wall 33 of the insulating body 30, the upper metal panel 70 and the insulating body 30 are integrated as a whole, and these components together with the lower metal panel 60 constitute a metal housing for the FPC connector 20, and thus electrically connecting the internal bending board 62*b* of the lower metal panel 60.

To prevent the movable lid 40 and the insulating body 30 from detaching with each other during the operation of the FPC connector 20, the present invention builds a separation-resisting panel 72*a* protruded from both sides of the panel 71 of the upper metal panel 70 as shown in FIG. 6.

If the upper metal panel 70 and the lower metal panel 60 define the metal housing of the FPC connector 20, the separation-resisting boards 72*a* on both sides of the upper metal panel 70 exactly shield the sliding space 66 between the sidewalls 32 on both sides of the insulating body 3 and the external bending board 62*a* on both sides of the lower metal panel 60, and thus constituting an overhead shielding above the sliding groove space 66 as shown in FIG. 7. After the wings 42 of the movable lid 40 enter the interior of the sliding groove space, such arrangement can achieve the effect of preventing the movable lid 40 and the insulating body 30 from being separated from each other.

As shown in FIGS. 4, 7 and 8, to strengthen the assembling structure between the insulating body 30 and the upper metal panel 70, an embedding rib 73 is bent downward and disposed on the panel 71 of the upper metal panel 70. If the upper metal panel 70 and the insulating body 30 are integrated as a whole, the panel 31 of the insulating body 30 is embedded into the embedding rib 73 of the upper metal panel 70 to achieve the effect of strengthening the assembling structure between the insulating body 30 and the upper metal panel 70.

Referring to FIGS. 4 to 7, the present invention provides two embodiments of movable lid 40. Besides the one that may engage a grounding metal panel 80, the two embodiments are substantially the same. Both comprise a long guide board 41, a long rod shaped wing 42 disposed on both sides of the guide board 41 and a blocking member 42*a* disposed on the front edge of the external side of each wing 42.

In FIGS. 6 and 7, since the wing 42 of the movable lid 4 is flexible when the movable lid 40 is installed, therefore a gentle squeeze can be applied onto the wings 42 disposed on both sides of the movable lid 40, so that the wings 42 on both sides of the movable lid 40 together with the blocking members 42*a* on the external side of the wings 42 can pass successfully through the sliding space 66 between the sidewalls 32 on both sides of the insulating body 30 and the external bending boards 62*a* on both sides of the lower metal panel 60.

Once the squeezing force vanishes, the wings 42 on both sides of the movable lid 40 will be opened outward immediately and resume the original position, so that the blocking member 42*a* at the external side of the wing 42 shall achieve its blocking function. In FIGS. 2, 3 and 7, if the movable lid 40 corresponding to the insulating body 30 of the FPC connector 20 is pushed in and fixed in place, the guide board 41 of the movable lid 40 will be extended into the embedding groove 34 of the insulating body 30. If the movable lid 40 corresponding to the insulating body 30 of the FPC connector 20 is pulled out, the blocking member 42*a* on the external side of the wing 42 of the movable lid 40 will be blocked by the external bending board 62*a* of the lower metal panel 60.

Such arrangement shall restrict the movable lid 40 from continuing its movement and stop the movable lid from being pulled out further.

As shown in FIGS. 4 to 6, the grounding metal panel 80 of this present invention comprises a long panel 81, and both sides of the panel 81 have a bending section 82 being bent upward (refer to the figure for the direction), and a contact panel 81*a* protruded forward from a rear side end of the surface of the panel 81 and located under the panel 81, such that an embedding groove 81*b* is defined between the panel 81 of the grounding metal panel 80 and the contact panel 81*a*. In the meantime, a positioning groove 83, a separation-resisting rib 84 and a positioning rib 85 are stamped and formed by a stamping technology onto both surfaces of the panel 81 at a position proximate to the surface of the bending section 82.

As shown in FIGS. 4 to 8, another kind of movable lid 40 of this present invention may connect and shelter with the grounding metal panel 80. Such movable lid 40 has a guide board 41 and an embedding board 41*a* with embedding function and connectedly formed in front of the guide board 41. A fixed pin 43 is protruded individually from both surface of the guide board 41 and located at a position corresponding to the positioning groove 83 of the grounding metal panel 80.

Therefore, the embedding board 41*a* of the guide board 41 of this kind of movable lid 40 as shown in FIG. 5 or 6 will be inserted into the embedding groove 81*b* of the grounding metal panel 80 and the fixed pin 43 of the guide board 41 of such movable lid 40 is latched into the positioning groove 83 on the panel 81 of the grounding metal panel 80 to secure the grounding metal panel 80 on the guide board 41 of the movable lid 40.

As shown in FIGS. 3, 5 and 7, according to the FPC connector 20 having a grounding metal panel 80 of this present invention, after the movable lid 40 is pulled out for using the FPC connector 20, the grounding metal panel 80 on the guide board of the movable lid 40 is also pulled out accordingly. Therefore, the contact end section 95*a* of the FPC 95 as shown in FIG. 1 is placed slantingly into the back of the separation-resisting rib 84 of the grounding metal panel 80 (refer to the direction as indicated in the figures), and then the FPC 95 is placed flatly, so that the neck section 95*b* of the FPC falls into the space between the two positioning ribs 85 on both sides of the grounding metal panel 80 and is fixed in place, and thus will not fall out due to the restriction by the separation-resisting rib 84, and further will push the movable lid. The contact end section 95*a* of the FPC 95 will enter into the embedding groove 34 of the insulating body 30 and electrically connect with the terminal pins 50.

In FIGS. 7 and 8, since the contact panel 81*a* of the grounding metal panel 80 disposed on the guide board 41 of the movable lid 40 is electrically coupled with the lower metal panel 60, therefore the noise or electromagnetic wave produced by the FPC 95 will be directed and dispersed to the ground through the grounding pin 65 of the lower metal panel 60.

Although the kind of PFC connector 20 does not come with a grounding metal panel 80 on the guide board 41 of the movable lid 40, by use of the structures of the separation-resisting rib 84 and the positioning rib 85 designed on the grounding metal panel 80, the FPC 95 will still not fall out and shall be electrically connected with the terminal pins 50.

In summation of the description above, the FPC connector 20 of this present invention is an EMI resisting FPC connector 20 and comprises a metal housing capable of shielding electromagnetic waves and having the functions of suppressing and eliminating external noises or electromagnetic waves, and thus shall prevent damages, deformations and distortions to signal transmission and also shall enhance the stability of system operations.

In the meantime, the present invention also discloses another EMI resisting FPC connector 20 which has a grounding metal panel 80 built on the guide board 41 of the movable lid 40 of the FPC connector 20, besides having a metal housing for shielding electromagnetic waves, the FPC connector 20 by itself also has the functions of suppressing and elimination external noises or electromagnetic interference. By electrically connecting the grounding metal panel 80 with the metal housing of the FPC connector 20, the noise or electromagnetic wave produced by the FPC 95 will be directed and dispersed to the ground through the grounding pins 65 of the lower metal panel 60.

Therefore, this kind of FPC connector 20 shall fully comply with the standard of electromagnetic interference control and shall enhance the electromagnetic compatibility among electronic products.

What is claimed is:

1. An electromagnetic interference (EMI) resisting flexible printed circuit (FPC) connector, comprising an insulating body, a movable lid, a plurality of terminal pins, a lower metal panel, and an upper metal panel to define said FPC connector with a metal housing; wherein said insulating body having an open pocket shape and a hollow embedded groove disposed at its bottom, and said embedded groove having a plurality of channels therein for receiving a pin disposed individually at the front section of said plurality terminal pins, and an embedding section having a guide track structure individually disposed on both sides of said insulating body and each embedding section having a channel thereon;

said movable lid, having a long guide board and two long rod shaped wing individually formed on both sides of said guide board, and each wing having a block member protruded from a front edge on the external side of said each wing;

said plurality of terminal pins having pins disposed at its front section and individually embedded into said embedding groove of said insulating body and pins disposed at the rear section of said plurality of terminal pins being exposed to the outside;

said lower metal panel, comprising a long panel, a pair of grounding pins, and two split bending boards individually disposed on both sides of said panel, wherein one of said split bending boards being drawn backward to form an internal bending board, and the other being outwardly opened to form an external bending board; and said two corresponding internal bending boards of lower metal panel are individually embedded and engaged with said embedding section of the insulating body, and said panel of lower metal panel is constituted as the bottom of said embedded groove of said insulating body, thereby said insulating body having a metal housing at its bottom, and each external bending board of lower metal panel is defined as a sliding space for accommodating said corresponding wing of movable lid and allowing said wing to slide in said sliding space; and said upper metal panel, having a long panel, and said each panel having a bending section individually disposed on both sides of said panel and being embedded into said channel of the embedding section disposed on both sides of said insulating body, thereby said panel of said upper metal panel covering and sheltering the top of said insulating body and constituting a metal housing at the top of said insulating body.

2. The electromagnetic interference (EMI) resisting flexible printed circuit (FPC) connector of claim 1, wherein on both sides of back wall of said insulating body respectively has a embedding hole which interconnected with said corresponding channel of the embedding section; and each front end of the bending section of the upper metal panel is formed as an insert pin, and each insert pin of said upper metal panel is correspondingly embedded inside each embedding hole of said insulating body.

3. The electromagnetic interference (EMI) resisting flexible printed circuit (FPC) connector of claim 1, wherein said internal bending board of lower metal panel comprises a first bending board, a second bending board and a tenon groove defined by said first bending board and said second bending board, and on lateral side of sidewalls of said insulating body has a latch member which shall be latched into said tenon groove of lower metal panel.

4. The electromagnetic interference (EMI) resisting flexible printed circuit (FPC) connector of claim 1, wherein on the front side of back wall of said insulating body has a channel structure, and on the panel of said lower metal panel at least has a insert pin which shall be embedded into said channel structure of insulating body.

5. The electromagnetic interference (EMI) resisting flexible printed circuit (FPC) connector of claim 1, wherein said upper metal panel has a separation-resisting panel protruded from its side end.

6. The electromagnetic interference (EMI) resisting flexible printed circuit (FPC) connector of claim 1, wherein said upper metal panel at least has a embedding rib which is bent downward and disposed on the panel of said upper metal panel and provided said insulating body shall be embedded into said embedding rib.

7. The electromagnetic interference (EMI) resisting flexible printed circuit (FPC) connector of claim 1, wherein on a vertical surface of said internal bending board of lower metal panel has a tenon groove, and on lateral side of sidewalls of said insulating body has a latch member which shall be latched into said tenon groove of lower metal panel.

8. The electromagnetic interference (EMI) resisting flexible printed circuit (FPC) connector of claim 7, wherein on the front side of back wall of said insulating body has a channel structure, and on the panel of said lower metal panel at least has a insert pin which shall be embedded into said channel structure of insulating body.

9. The electromagnetic interference (EMI) resisting flexible printed circuit (FPC) connector of claim 7, wherein said upper metal panel has a separation-resisting panel protruded from its side end.

10. The electromagnetic interference (EMI) resisting flexible printed circuit (FPC) connector of claim 9, wherein said upper metal panel at least has a embedding rib which is bent downward and disposed on the panel of said upper metal panel and provided said insulating body shall be embedded into said embedding rib.

11. An electromagnetic interference (EMI) resisting flexible printed circuit (FPC) connector, comprising an insulating body, a movable lid, a plurality of terminal pins, a lower metal panel, an upper metal panel and a grounding metal panel to define said FPC connector with a metal housing; wherein said insulating body having an open pocket shape and a hollow embedded groove disposed at its bottom, and said embedded groove having a plurality of channels therein for receiving a pin disposed individually at the front section of said plurality terminal pins, and an embedding section having a guide track structure individually disposed on both sides of said insulating body and each embedding section having a channel thereon;

said movable lid, having a long guide board, two long rod shaped wing individually formed on both sides of said guide board and each wing having a block member protruded from a front edge on the external side of said each wing, a fixed pin being individually disposed on both sides of the surface of said guide board, and an embedding board having an embedding function and being formed on the surface of said guide board;

said plurality of terminal pins having pins disposed at its front section and individually embedded into said embedding groove of said insulating body and pins disposed at the rear section of said plurality of terminal pins being exposed to the outside;

said lower metal panel, comprising a long panel, a pair of grounding pins, and two split bending boards individually disposed on both sides of said panel, wherein one of said split bending boards being drawn backward to form an internal bending board, and the other being outwardly opened to form an external bending board; and said two corresponding internal bending boards of lower metal panel are individually embedded and engaged with said embedding section of the insulating body, and said panel of lower metal panel is constituted as the bottom of said embedded groove of said insulating body, thereby said insulating body having a metal housing at its bottom, and each external bending board of lower metal panel is defined as a sliding space for accommodating said corresponding wing of movable lid and allowing said wing to slide in said sliding space;

said upper metal panel, having a long panel, and said each panel having a bending section individually disposed on both sides of said panel and being embedded into said channel of the embedding section disposed on both sides of said insulating body, thereby said panel of said upper metal panel covering and sheltering the top of said insulating body and constituting a metal housing at the top of said insulating body; and said grounding metal panel, having a long panel and a positioning groove being individually disposed on both sides of said panel, and a contact panel being protruded from an end section of the surface of said panel and disposed under said panel, thereby said panel of said grounding panel and said contact panel defining an embedding groove, and the embedding board of said guide board of said movable lid being inserted into said embedding groove of said grounding metal panel and a fixed pin of said guide board of said movable lid being inserted into said positioning groove of said panel of said grounding metal panel.

12. The electromagnetic interference (EMI) resisting flexible printed circuit (FPC) connector of claim 11, wherein on both sides of back wall of said insulating body respectively has a embedding hole which interconnected with said corresponding channel of the embedding section; and each front end of the bending section of the upper metal panel is formed as an insert pin, and each insert pin of said upper metal panel is correspondingly embedded inside each embedding hole of said insulating body.

13. The electromagnetic interference (EMI) resisting flexible printed circuit (FPC) connector of claim 11, wherein at least a contact member is protruded from the surface of the panel of said lower metal panel.

14. The electromagnetic interference (EMI) resisting flexible printed circuit (FPC) connector of claim 11, wherein on the front side of back wall of said insulating body has a channel structure, and on the panel of said lower metal panel at least has a insert pin which shall be embedded into said channel structure of insulating body.

15. The electromagnetic interference (EMI) resisting flexible printed circuit (FPC) connector of claim 11, wherein said upper metal panel has a separation-resisting panel protruded from its side end.

16. The electromagnetic interference (EMI) resisting flexible printed circuit (FPC) connector of claim 11, wherein said upper metal panel at least has a embedding rib which is bent downward and disposed on the panel of said upper metal panel and provided said insulating body shall be embedded into said embedding rib.

17. The electromagnetic interference (EMI) resisting flexible printed circuit (FPC) connector of claim 11, wherein on a vertical surface of said internal bending board of lower metal panel has a tenon groove, and on lateral side of sidewalls of said insulating body has a latch member which shall be latched into said tenon groove of lower metal panel.

18. The electromagnetic interference (EMI) resisting flexible printed circuit (FPC) connector of claim 17, wherein on the front side of back wall of said insulating body has a channel structure, and on the panel of said lower metal panel at least has a insert pin which shall be embedded into said channel structure of insulating body.

19. The electromagnetic interference (EMI) resisting flexible printed circuit (FPC) connector of claim 17, wherein said upper metal panel has a separation-resisting panel protruded from its side end.

20. The electromagnetic interference (EMI) resisting flexible printed circuit (FPC) connector of claim 19, wherein said upper metal panel at least has a embedding rib which is bent downward and disposed on the panel of said upper metal panel and provided said insulating body shall be embedded into said embedding rib.

* * * * *